US005292633A

United States Patent [19]

Okumura et al.

[11] Patent Number: 5,292,633

[45] Date of Patent: Mar. 8, 1994

[54] SILVER HALIDE BLACK & WHITE LIGHT-SENSITIVE MATERIAL COMPRISING SPECTRALLY SENSITIZED SILVER HALIDE GRAINS CONTAINING RHODIUM IN A SPECIFIC AMOUNT

[75] Inventors: Mitsuhiro Okumura; Masataka Nakano; Yuji Tanaka, all of Hinoo, Japan

[73] Assignee: Konica Corporation, Tokyo, Japan

[21] Appl. No.: 828,132

[22] Filed: Jan. 30, 1992

[30] Foreign Application Priority Data

Feb. 4, 1991 [JP] Japan ..... 3-13330

[51] Int. Cl.[5] ..... G03C 1/005; G03C 1/494

[52] U.S. Cl. ..... 430/574; 430/576; 430/577; 430/605

[58] Field of Search ..... 430/605, 569, 576, 577, 430/574

[56] References Cited

U.S. PATENT DOCUMENTS

| | | | |
|---|---|---|---|
| 3,837,862 | 9/1974 | Shiba et al. | 430/577 |
| 4,173,483 | 11/1979 | Habu et al. | 430/577 |
| 4,783,398 | 11/1988 | Takado et al. | 430/577 |
| 4,814,264 | 3/1989 | Kishida et al. | 430/577 |
| 4,837,140 | 6/1989 | Ikeda et al. | 430/577 |
| 5,126,237 | 6/1992 | Okumura et al. | 430/574 |

FOREIGN PATENT DOCUMENTS

| | | | |
|---|---|---|---|
| 0103018 | 8/1979 | Japan | 430/569 |
| 0171947 | 9/1984 | Japan | 430/605 |
| 0212827 | 12/1984 | Japan | 430/569 |
| 3115159 | 5/1988 | Japan | 430/569 |
| 1285941 | 11/1989 | Japan | 430/605 |
| 3-290646 | 12/1991 | Japan . | |

*Primary Examiner*—Charles L. Bowers, Jr.
*Assistant Examiner*—Geraldine Letscher
*Attorney, Agent, or Firm*—Frishauf, Holtz, Goodman & Woodward, P.C.

[57] ABSTRACT

A silver halide black and white photographic light-sensitive material which is improved in pressure resistance and storage stability is disclosed comprising a support having thereon a silver halide emulsion layer comprising silver halide grains, wherein said silver halide grains contain rhodium in an amount of $10^{-8}$ to $10^{-5}$ moles per mol of silver halide; and said grains are spectrally sensitized with a combination of sensitizing dyes (GS-1) and (RS-1), each represented by the following formula:

formula (GS-1)

formula (RS-1)

11 Claims, No Drawings

SILVER HALIDE BLACK & WHITE LIGHT-SENSITIVE MATERIAL COMPRISING SPECTRALLY SENSITIZED SILVER HALIDE GRAINS CONTAINING RHODIUM IN A SPECIFIC AMOUNT

FIELD OF THE INVENTION

This invention relates to a silver halide photographic light sensitive material and particularly to the silver halide photographic light sensitive material improved in both of the pressure resistance and raw-stock aging preservability of a black-and-white light sensitive print material which is to be printed from a color transmission type light sensitive material.

BACKGROUND OF THE INVENTION

In recent years, transmission type light sensitive materials have been getting increased in the demands for color prints. In general, most prints have been printed on color paper and, on the other hand, there have been increasing cases where color prints have been made on black-and-white print paper from color negative films. At newspaper publishing companies and press agencies in particular, there has shown an increasing tendency to take an advantage that a single color negative film already photographed is applied to make a color gravure and an ordinary black-and-white print, so that the frequency of making use of color negative films has rapidly been increased. Recently among the press mentioned above, there has shown a tendency to replace a manual processing of black-and-white print paper with a roomlight handling type printer/processor unit so as to save the darkroom space. Accordingly, there have been demands for processing a black-and-white printing material capable of providing high-quality black-and-white prints from color negative films, which is suitable for making use of a printer/processor unit.

The tendencies of the recent printer/processor units include, for example, an essential factor that the latitude against pressure troubles is to be high in the tide of making further advances of high speed processing operations and, therefore, a light sensitive printing material has been so demanded that any image quality may not seriously be affected by the troubles such as undesirable sensitization, fog or desensitization produced by some slight damage produced in a printer/processor unit. It is also essential that any speeds or contrasts is not to be varied while a raw test sample is preserved for aging so that the printing conditions having once been set up should not be necessary to be changed and, therefore, a light sensitive material having an excellent storage stability has been demanded.

OBJECTS OF THE INVENTION

It is an object of the invention to provide a black-and-white light sensitive printing material capable of being printed from a transmission type light sensitive color material having excellent image qualities such as color sensitivity, graininess and image sharpness, that is a silver halide light sensitive material capable of producing no pressure trouble in an exposure operation carried out through a printer/processor unit, but displaying excellent stabilities such as a constant sensitive speed and a constant contrasts each invariable on storage of the raw material.

It was discovered that the above-mentioned objects of the invention can be achieved with the following light sensitive material, so that the invention could be invented. In a silver halide photographic light sensitive material comprising a support provided thereonto with at least one silver halide emulsion layer, silver halide grains contained in the emulsion layer contain rhodium in an amount of $10^{-8}$ to $10^{-5}$ mols per mol of silver halide when preparing the silver halide grains and the grains are spectrally sensitized with the combination of sensitizing dyes (BS-1), (GS-1) and (RS-1) or the combination of (GS-1) and (RS-1), each represented by the following formula.

Formula (BS-1)

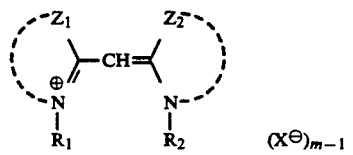

wherein $Z_1$ and $Z_2$ represent each a group consisting of non-metal atoms necessary for forming an oxazole ring, a thiazole ring, a selenazole ring, a pyridine ring, a benzoxazole ring, a benzoselenazole ring, a benzoimidazole ring, a naphthoxazole ring, a naphthothiazole ring, a naphthoselenazole ring, a naphthoimidazole ring or a quinoline ring; $R_1$ and $R_2$ represent each an alkyl group, a substituted alkyl group, an alkenyl group or an aryl group; X represents an anion; and m is an integer of 1 or 2.

Formula (GS-1)

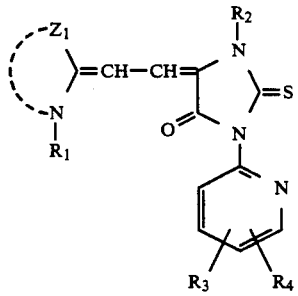

wherein $Z_1$ represents a group consisting of non-metal atoms necessary for forming an oxazole ring, a benzoxazole ring or a naphthoxazole ring, provided, these rings may have a substituent on the carbon atom thereof; $R_1$ and $R_2$ represent each an alkyl group or a substituted alkyl group; and $R_3$ and $R_4$ represent each a hydrogen atom, an alkyl group, an alkoxy group, a sulfo group, a sulfoalkyl group, a carboxy group or a halogen atom.

Formula (RS-1)

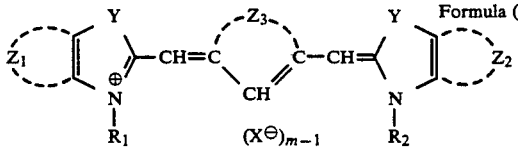

wherein $R_1$ and $R_2$ represent each an alkyl group or a substituted alkyl group; and $Z_1$ and $Z_2$ represent each a group consisting of non-metal atoms necessary for forming a benzene ring or a naphthalene ring each condensed with a thiazole ring or a selenazole ring; $Z_3$ represents an atomic group necessary for forming a 6-membered hydrocarbon ring; m is an integer of 1 or 2;

Y represents a sulfur atom or a selenium atom; and X represents an anion.

DETAILED DESCRIPTION OF THE INVENTION

In the photographic light sensitive materials applicable to the invention, the silver halide emulsions thereof are generally those of the silver halide grains dispersed in a hydrophilic colloids. The silver halides include, for example, silver bromide, silver chlorobromide, silver iodobromide, silver chloroiodobromide or the mixtures thereof.

The silver halide emulsions applicable to the invention include, preferably, silver bromide, silver chlorobromide and silver chloride.

The silver halide emulsions applicable to the invention can be prepared in any one of a variety of processes including, for example, an acidic process, a neutralizing process, an alkaline process and an ammoniacal process. In addition, a normal precipitation process, a reverse precipitation process, a double-jet precipitation process, a pAg controlled double-jet precipitation process and a conversion process may each be applied.

There is no special limitation to the grain sizes of silver halide grains, however, those having an average grain-size smaller than 0.5 μm are desirably used and it is preferable to use the so-called monodisperse type grains of which not less than 90% of the whole grain number are within the range of ±40% of the average grain size thereof. The crystal habits of the above-mentioned silver halide grains may be any one of the cube, tetradecahedron or octahedron and may further be of the tablet type disclosed in Japanese Patent Publication Open to Public Inspection -hereinafter referred to as 'JP OPI Publication'- No. 58-108525/1983.

From the viewpoint of improving the pressure resistance of the silver halide emulsions applicable to the invention, it is essential to contain a water-soluble rhodium salt therein in the course of carrying out a silver halide grain precipitating process or a physical ripening process.

The above-mentioned water-soluble rhodium salts applicable to the invention include, for example, a rhodium dioxide, rhodium trichloride and ammonium rhodium-hexachloride and, preferably, the halogeno-complex compounds of a trivalent rhodium such as hexachlororhodium (III) acid or the salts thereof.

The water-soluble rhodium salts applicable to the invention may be added in an amount desirably within the range of $10^{-8}$ to $10^{-5}$ mols per mol of a silver halide contained in a silver halide emulsion layer of the invention. When such a water-soluble rhodium salt as mentioned above is added in an amount less than $10^{-8}$ mols per mol of the silver halides, any expected effects may not be displayed. When exceeding $10^{-5}$ mols, any practical application may not be received because a desensitization or a contrast reduction may break out.

In the invention, the above-mentioned water-soluble rhodium salts are made present in preparing the silver halide emulsions for the silver halide emulsion layers of the invention. The expression, '—in preparing an emulsion —', means the course of an precipitation of silver halide grains or a physical ripening treatment thereafter. The water-soluble rhodium salts may be added in any desired method at any desired point of time in the above-mentioned course. It is, however, preferable that the water-soluble rhodium salts are to be added at the time of precipitation in a method that the emulsion is prepared by adding a halide solution containing the water-soluble rhodium salts. The reason why the point of time of adding them and the method of the addition thereof are preferred is as follows. For the purpose of displaying the optimum effects of rhodium, the rhodium atoms have to be distributed uniformly from the inside of each silver halide grain to the surface thereof.

In the invention, the above-mentioned rhodium salts may be used together with a cadmium salt, a zinc salt, a thallium salt, an iridium salt or the complex salts thereof in combination. Among them, in particular, iridium salts and the complex salts thereof are preferably used in combination with the rhodium salts. The iridium salts applicable in combination thereto include, for example, an iridium (III) halide compound and an iridium (IV) halide compound such as, typically, iridium trichloride, iridium tribromide, iridium (III) potassium hexachloride, iridium (III) ammonium sulfate, iridium (III) potassium disulfate, iridium (III) tripotassium trisulfate, iridium (III) sulfate, iridium (III) trioxalate, iridium tetrachloride, iridium tetrabromide, iridium (IV) potassium hexachloride, iridium (IV) ammonium hexachloride, iridium (IV) potassium acid and iridium (IV) trioxalate. However, there is no limitation thereto.

The silver halide emulsions applicable to the invention may be chemically sensitized with a variety of sensitizers.

It is permitted to make use of, for example, sulfur sensitizers (including hypo, thiourea and active gelatin), noble metal sensitizers (including gold sensitizers such as gold chloride and gold thiocyanate, platinum salts, palladium, iridium salts, rhodium salts and ruthenium salts) and reduction sensitizers (including stannous chloride, thiourea dioxide and hydrazine derivatives), either independently or in combination.

When investigating the photographic characteristics of the emulsions chemically sensitized with the above-given sensitizers, it was proved that the emulsions each added therein with water-soluble rhodium were seriously deteriorated in raw stock stability due to the addition of the rhodium, though the pressure resistance of the resulting emulsions were relatively improved as compared to the pressure resistance obtained from the emulsions not added with rhodium.

As the results of the studies on the above-mentioned points made by the present inventors, it was discovered the amazing facts that the raw stock stability can be improved with maintaining the improvement of the pressure resistance when a spectral sensitization is carried out with the use of specific sensitizing dyes in combination, so the the present inventors could achieve the invention. The above-mentioned sensitizing dyes relating to the invention will now be detailed below.

In the sensitizing dyes represented by the foregoing formula [BS-1], the heterocyclic rings represented by $Z_1$ and $Z_2$ include, desirably, a thiazole ring, a selenazole ring, a benzothiazole ring, a benzoselenazole ring and a naphthothiazole ring, more desirably, a benzothiazole ring and a benzoselenazole ring and, preferably, a benzothiazole ring.

The heterocyclic rings represented by $Z_1$ and $Z_2$ may have each a substituent. The preferable substituents include, for example, a halogen atom, a hydroxyl group, a cyano group, an alkyl group, an aryl group and an alkoxy group.

Among the halogen atoms, a chlorine atom is preferable. Among the aryl groups, a phenyl group is preferable. Among the alkyl groups, a straight-chained or branched alkyl group having 1 to 4 carbon atoms is desirable and they include, for example, a methyl group, an ethyl group, a propyl group, an isopropyl group and a butyl group. Among them, a methyl group is preferable. Among the alkoxy groups, an alkoxy group having 1 to 4 carbon atoms is desirable and they include, for example, a methoxy group, an ethoxy group and a propoxy group. Among them, a methoxy group is preferable.

The alkyl groups represented by $R_1$ and $R_2$ include, desirably, a straight-chained or branched alkyl group having 1 to 6 carbon atoms is desirable and, among them, a methyl group, an ethyl group, a propyl group and an isopropyl group are preferable. The above-given alkyl groups may also be substituted. The substituents include, desirably, a sulfo group, a carboxyl group, a hydroxyl group, an alkoxycarbonyl group and an alkylsulfonylamino group. They include, typically, a 2-sulfoethyl group, a 3-sulfopropyl group, a 4-sulfobutyl group, a 3-sulfobutyl group, a carboxy group, a 2-carboxyethyl group, a 2-ethoxycarbonylethyl group, a 2-hydroxyethyl group and a 2-methylsulfonylaminoethyl group.

The alkyl groups represented by $R_1$ and $R_2$ include, desirably, an alkyl group substituted with a sulfo group or a carboxyl group and, among them, an alkyl group substituted with a carboxyl group is preferable. The sulfo groups and carboxyl groups are each allowed to produce the salts in combination with an organic ion such as pyridium ion and triethyl ammonium ion or an inorganic cation such as ammonium ion, sodium ion and potassium ion.

The anions represented by X include, desirably, chlorine ion, bromine ion, iodine ion and p-toluene sulfonic acid ion and, among them, a halogen ion is preferable. When forming an intramolecular salt, no cation may be contained and, when this is the case, m is an integer of 1.

Now, the typical examples of the sensitizing dyes represented by formula [BS-1] will be given below. It is, however, to be understood that the invention shall not be limited thereto.

BS-1-1

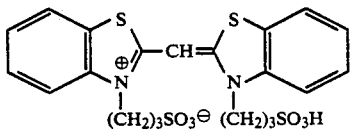

BS-1-2

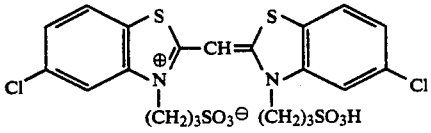

BS-1-3

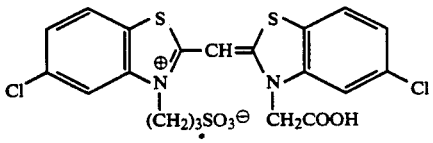

BS-1-4

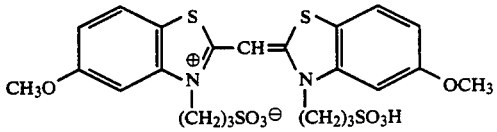

-continued

BS-1-5

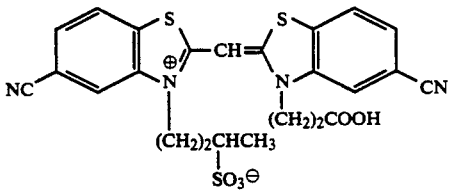

BS-1-6

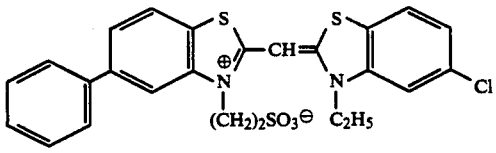

BS-1-7

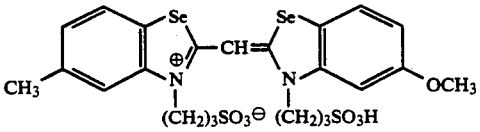

BS-1-8

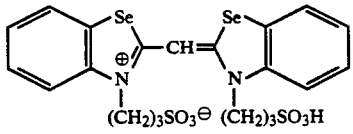

In the foregoing formula [GS-1], the heterocyclic rings each represented by $Z_1$ may have a substituent which include, for example, an alkyl group, having 1 to 4 carbon atoms, an alkoxy group, a phenyl group, an alkoxycarbonyl group or a halogen atom such as a chlorine atom.

The alkyl groups and the substituted alkyl groups each represented by $R_1$ and $R_2$ are synonymous with those represented by $R_1$ and $R_2$ denoted in the foregoing formula [I]; and $R_3$ and $R_4$ represent each a hydrogen atom, an alkyl group having 1 to 4 carbon atoms, an alkoxy group, a sulfo group, a sulfoalkyl group, a carboxyl group and a halogen atom (such as a chlorine atom).

Now, the typical examples of the compounds represented by the above-given formula [GS-1], which are applicable to the invention, will be given below. It is, however, to be understood that the invention shall not be limited thereto.

GS-1-1

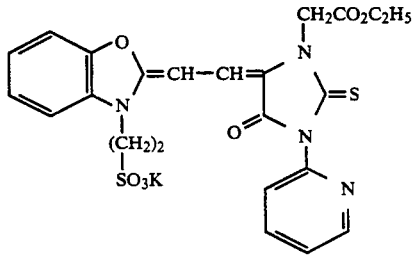

-continued
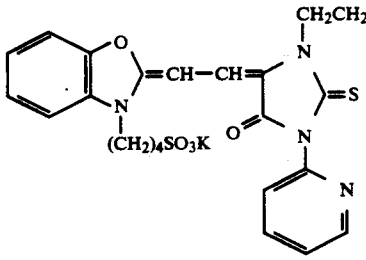
GS-1-2
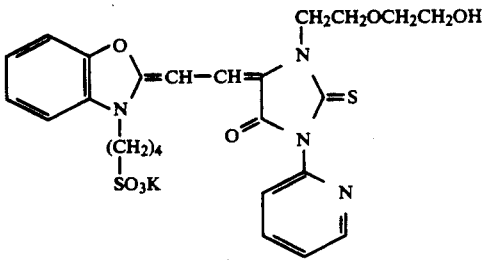
GS-1-3
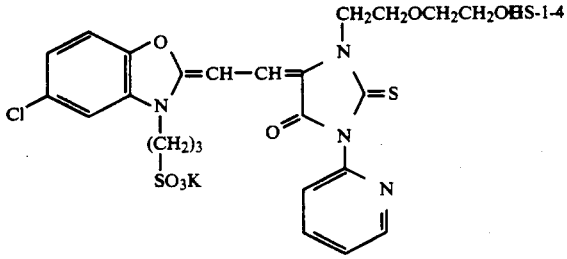
GS-1-4
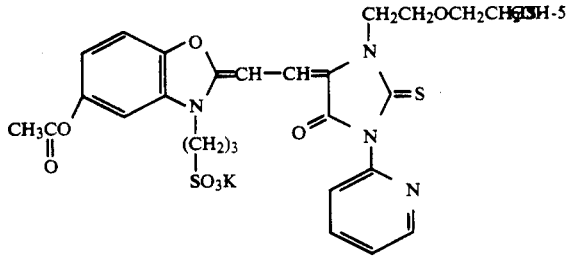
GS-1-5
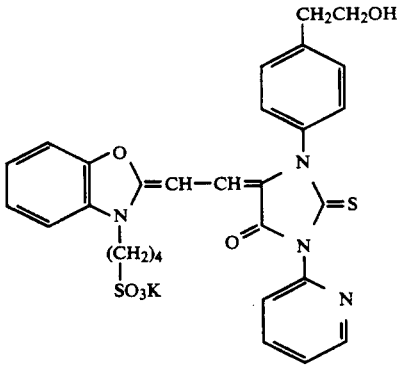
GS-1-6
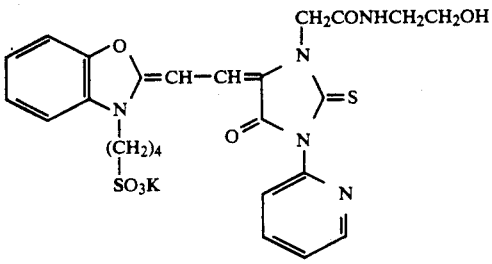
GS-1-7
-continued
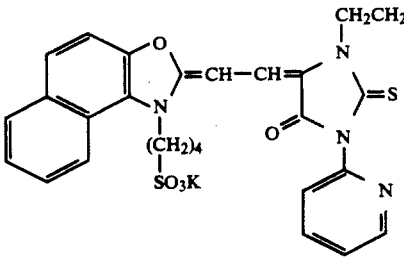
GS-1-8
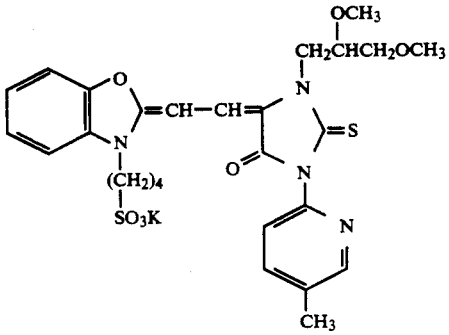
GS-1-9
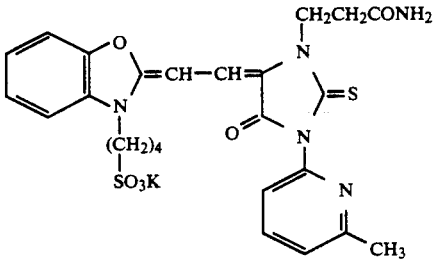
GS-1-10
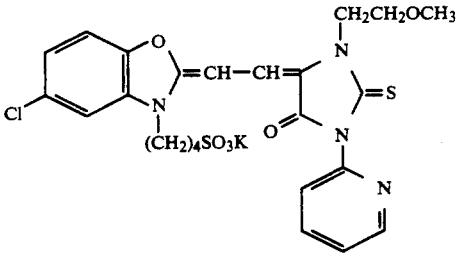
GS-1-11
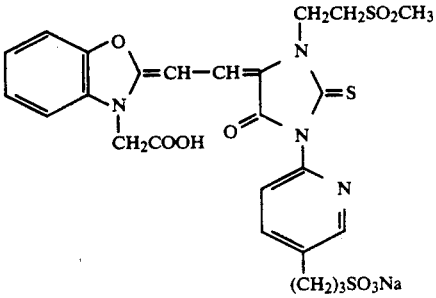
GS-1-12

-continued

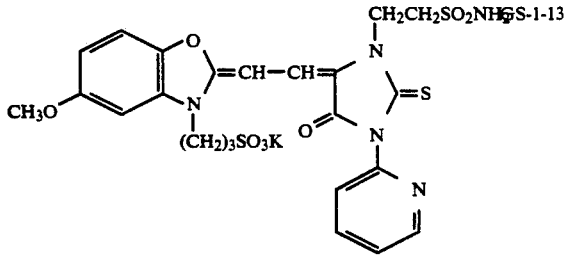

GS-1-13

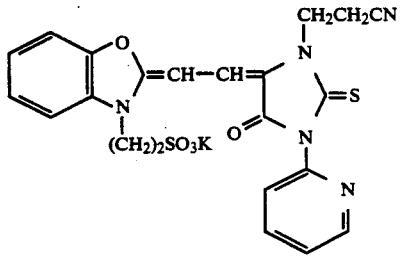

GS-1-14

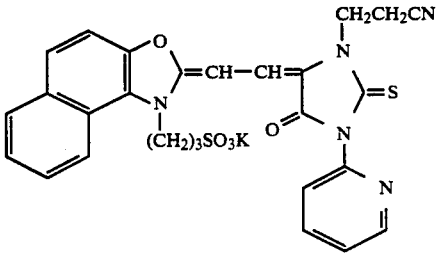

GS-1-15

-continued

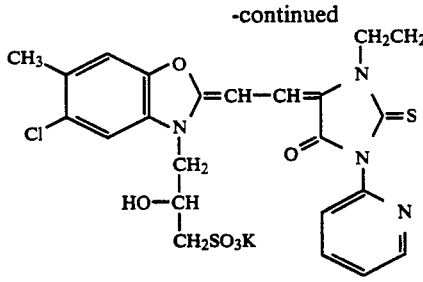

GS-1-16

In the foregoing formula [RS-1], $R_1$ and $R_2$ represent each a straight-chained or branched alkyl group which may have a substituent and $R_1$ and $R_2$ represent each a group selected from the group consisting of the following groups, for example, a methyl group, an ethyl group, an allyl group, a propyl group, a pentyl group, a chlroethyl group, a hydroxyethyl group, a methoxyethyl group, an acetoxyethyl group, a carboxyethyl group, an ethoxycarbonylmethyl group, a sulfoethyl group, a sulfopropyl group, a sulfobutyl group, a $\beta$-hydroxy-$\gamma$-sulfopropyl group and a sulfonaphthopropyl group. The condensed rings each formed by $Z_1$ and $Z_2$ may have a substituent which include, desirably, a halogen atom, an aryl group, an allyl group or an alkoxy group and, preferably, a halogen atom (such as a chlorine atom), a phenyl group and a methoxy group. X represents an anion (including, for example, Cl, Br, I,

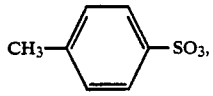

$CH_3SO_4$ and $C_2H_5SO_4$), and m is an integer of 1 or 2, provided, when the compound forms an intramolecular salt, m is an integer of 1.

Now, the typical examples of the sensitizing dyes preferably applicable to the invention, which are represented by the foregoing formula [I], will be given below. It is, however, to be understood that the invention shall not be limited thereto.

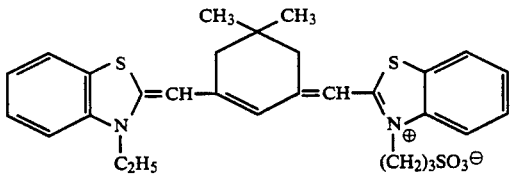

RS-1-1

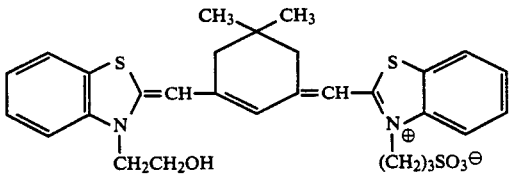

RS-1-2

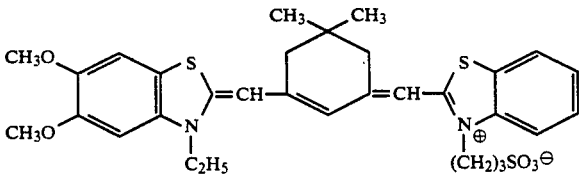

RS-1-3

-continued

RS-1-4

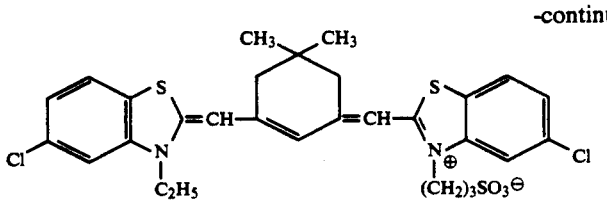

RS-1-5

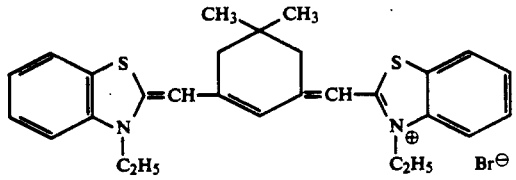

RS-1-6

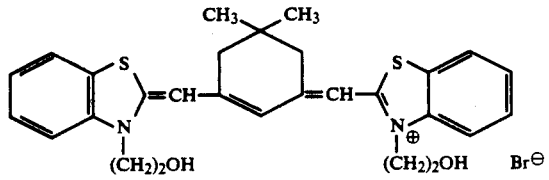

RS-1-7

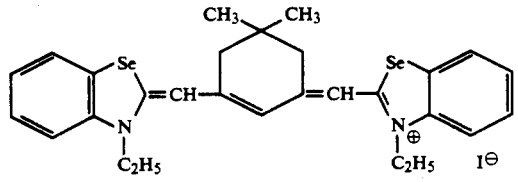

RS-1-8

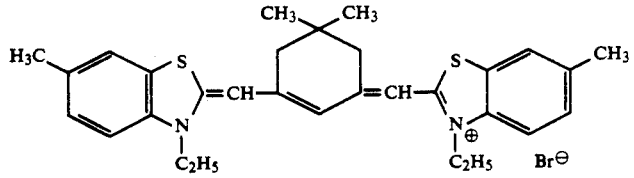

The sensitizing dyes represented by the above-given formulas [RS-1] and [BS-1], which are applicable to the invention, may readily be synthesized in the methods detailed in, for example, F. M. Hammer, 'The Chemistry of Heterocyclic Compounds', Vol.18, 'The Cyanine Dyes and Related Compounds', A. Weissberger ed. Interscience Co., New York, 1964.

The sensitizing dyes represented by the above-given formula [GS-1]can be synthesized according to the methods for synthesizing dimethine melocyanine, each described in, for example, Japanese Patent Examined Publication Nos. 46-549/1971, 46-18105/1971, 46-18106/1971, 46-18108/1971, 47-4085/1972 and 58-52574/1983 and U.S. Pat. Nos. 2,839,403, 3,381,486, 3,625,698, 3,480,439 and 3,567,458.

The sensitizing dyes represented by the above-given formulas [BS-1], [GS-1] and [RS-1] may be added in any amount without special limitation. However, they may commonly be added in an amount within the range of, desirably, $1\times10^{-7}$ to $1\times10^{-2}$ mols and, preferably, $5\times10^{-6}$ to $5\times10^{-4}$ mols, each per mol of silver halides used.

The sensitizing dyes may be added in any well-known methods well-known in the skilled in the art.

The sensitizing dyes may be added in the courses of the steps such as a silver halide grain forming step, a step precedent to or a step following a physical ripening step and the initial or late stage of a chemical ripening step. In the invention, the mixing ratio of the dyes represented by the formula [BS-1], [GS-1] and [RS-1] or the ratio of the dyes represented by the formula [GS-1] and [RS-1] shall not be limitative, but are suitably determined within the range of the aforementioned total amounts.

In the invention, a panchromatic type black-and-white light sensitive printing material is prepared by adding the combination of three kinds of the sensitizing dyes having the foregoing formula [BS-1], [GS-1] and [RS-1] or the combination of those having the foregoing formula [GS-1] and [RS-1] into an emulsion as described above. The reason why these dyes are added in an emulsion is that the color image qualities of a subject, such as color-density reproduction, graininess and image sharpness, are to be satisfied when an image is printed out of a color negative film. In particular, the excellent effects can be displayed in the combination of the dyes represented by formulas [GS-1] and [RS-1].

The supports applicable to the photographic light sensitive materials of the invention include, for example, a support comprising a sheet of paper, glass, cellulose acetate, cellulose nitrate, polyester, polyamide, polystyrene or polypropylene, or a laminate comprising two or more kinds of substrates including the sheets of paper and polyolefin (such as polyethylene and polypropylene) Among these supports, the laminates comprising the sheets of paper and polyolefin are preferred from the viewpoint of production costs.

As for the layer hardeners applicable to the invention, for example, it is permitted to use an organic hardener such as those of the vinyl sulfone type, cyanuric chloride type, acryloyl type or ethyleneimine type or an inorganic hardener such as those of the chrome alum type or potassium alum type, independently or in combination.

A variety of surfactants may be applied to the photographic light sensitive materials of the invention.

The above-mentioned surfactants applicable thereto include, for example, non-ionic surfactants such as saponin and polyalkylene glycol ether and anionic surfactants such as an alkylbenzene sulfonate, an alkylsulfate and a sulfosuccinate.

If required, a variety of other photographic additives may also be applied to the photographic light sensitive materials of the invention. For example, it is allowed to use a stabilizer, a coating aid, a physical property improving agent for coated layers, a UV absorbent, a fluorescent whitening agent, an antioxidant, a staining inhibitor, a metal-ion chelating agent, a thickener, a matting agent, an antihalation dye, an anti-irradiation dye and a developing agent. Among them, in particular, it is preferable to contain a specific developing agent in the photographic light sensitive materials of the invention so as to improve the raw stock stability.

The above-mentioned preferable developing agents include, for example, a dihydroxy benzene such as hydroquinone, chlorohydroquinone and catechol, and a 3-pyrazolidone such as 1-phenyl-3-pyrazolidone, 1-phenyl-4,4-dimethyl-3-pyrazolidone and 1-phenyl-4-methyl-4-hydroxymethyl-3-pyrazolidone.

Among these developing agents, hydroquinone is preferably be used. The amount thereof to be added would be within the range of, desirably, $1\times10^{-4}$ mols to $1\times10^{-1}$ mols and, preferably, $1\times10^{-3}$ to $1\times10^{-2}$ mols, each per mol of silver halides used, from the view point of displaying the effects without spoiling any other photographic characteristics.

When developing the silver halide photographic light sensitive materials of the invention, the developing agents applicable thereto include any kinds of desired developing agents which may be used so as to meet the light sensitive materials concretely prepared.

For example, the developing agents include those of the $HO-(CH{=}CH)_n-OH$ type such as hydroquinone), the $HO-(CH{=}CH)_n-NH_2$ type such as ortho- or para-aminophenol or aminopyrazolone and the $H_2N-(CH{=}CH)_n-NH_2$ type such as 4-amino-2-methyl-N,N-diethyl aniline.

Besides the above, it is also allowed to effectively applicable to the invention with the developing agents given in T. H. James, 'The Theory of the Photographic Process', 4th Ed., pp.291–334 and 'Journal of the American Chemical Society', Vol.73, p.3100, 1951.

The above-mentioned developing agents may be used independently or in combination. It is, however, preferable to use them in combination.

The effects of the invention may not be spoiled even when making use of a preserver including, for example, a sulfite such as sodium sulfite and potassium sulfite, in a developer used for developing the light sensitive materials of the invention. As for the above-mentioned preservers, a hydroxyamine compound or a hydrazide compound may be used. Besides the above, it is further allowed to provide a pH controlling function or a buffering function with caustic alkali, alkaline carbonic acid or amine and to add an inorganic development inhibitor such as potassium bromide, an organic development inhibitor such as benzotriazole, a metal-ion chelating agent such as ethylenediamine tetraacetic acid, a development accelerator such as methanol, ethanol, benzyl alcohol and polyalkylene oxide, a surfactant such as sodium alkylaryl sulfonate, natural saponin, sugar or the alkyl esters of the above-given compounds, a layer hardener such as glutar aldehyde, formalin and glyoxal, an ion-strength controller such as sodium sulfate, and so forth.

In the invention, the developers applicable thereto are allowed to contain an organic solvent such as an alkanolamine and a glycol.

In a developer having the above-mentioned composition, the pH value thereof may be within the range of 9 to 13 and, preferably, 10 to 12 from the viewpoints of the preservability and photographic characteristics of a light sensitive material to be developed.

The silver halide photographic light sensitive materials of the invention may be processed in a variety of conditions. Concerning the processing temperatures, a developing temperature, for example, is desirable to be not higher than 50° C. and preferably within the range of 30° to 40° C. Concerning the developing time, it is to be completed commonly within 3 minutes and preferably within 2 minutes because a better result may often be enjoyed in the latter case.

It is also arbitrary to take any other processing steps other than the developing step, such as a washing, stopping, stabilizing and fixing steps and, if required, a prehardening step and a neutralizing step. The above-mentioned processing steps may suitably be omitted and, further, these processing steps may be carried out either in the so-called manual developments such as a tray-development and a frame-development or in the so-called mechanical developments such as a roller-development and a hanger-development.

EXAMPLES Now, the invention will be detailed with reference to the examples thereof. It is, however, to be understood that the invention shall not be limited thereto.

EXAMPLE-1

Emulsions A through F were each prepared in the following method.

| [Emulsion] | | |
|---|---|---|
| Solution I | Gelatin | 20 g |
| | Water | 400 ml |
| Solution II | $AgNO_3$ | 60 g |
| | Water | 250 ml |
| | Aqueous ammonia (in a 28% solution) | 40 ml |
| Solution III | KBr | 42 g |
| | Water | 300 ml |
| Solution IV | $[RhCl_3]$* | See Table-1 |

*Solution IV was prepared by making an aqueous 0.01% solution and a specified amount thereof was taken out.

Solution IV was added into solution I and the resulting solution was heated up to 35°πC. While violently stirring the solution, solutions II and III were separately added into the solution I at the same time and the resulting mixture was ripened at the temperature as it was for 5 minutes and then the pH thereof was lowered with acetic acid to be pH 5.8 and also raised the temperature up to 40° C.

In the desalting step, the desalinization was carried out with Demol N (manufactured by Kao Corp) and magnesium sulfate, and then an additional gelatin was added thereinto, so that a dispersion was carried out.

The resulting silver halide emulsion was proved to be an emulsion containing monodispersed cubic crystals having an average grain size of 0.3 μm.

TABLE-1

| Emulsion No. | [$RhCl_3$] content |
|---|---|
| A | — |
| B | $1 \times 10^{-9}$ mols/AgX mol |
| C | $1 \times 10^{-8}$ mols/AgX mol |
| D | $1 \times 10^{-7}$ mols/AgX mol |
| E | $1 \times 10^{-5}$ mols/AgX mol |
| F | $1 \times 10^{-4}$ mols/AgX mol |

The resulting emulsion was added with sodium thiosulfate and was then subjected to the optimum chemical sensitization. After that, the following inhibitor SB-1 was added thereinto and the chemical sensitization was then stopped in reaction. Next, the sensitizing dyes shown in Table-2 and the following comparative sensitizing dyes A, B and C were added in each of the amounts shown in Table-2 and they were then spectrally sensitized, respectively.

Inhibitor SB-1

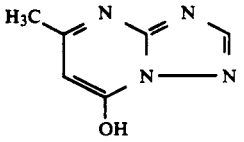

Comparative sensitizing dye A

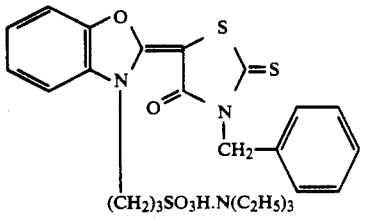

Comparative sensitizing dye B

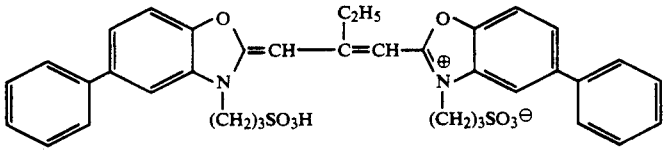

Comparative sensitizing dye C

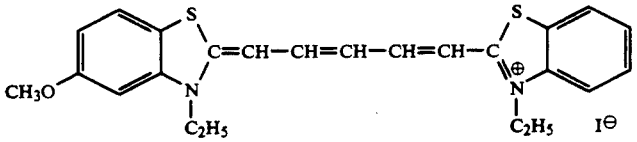

By making use of the resulting emulsion and onto a (200 μm-thick) paper support laminated on both sides thereof with polyethylene, an emulsion layer and a protective layer each having the following formulas respectively were coated at the same time, so that the test sample was prepared.

| (Emulsion layer) | |
|---|---|
| Binder: Gelatin | 2.8 g/m² |
| Silver coating weight: | 1.4 g/m² |
| Color-image toner: | 1.5 mg/m² |

-continued

| | |
|---|---|
| 1-[phenyl-5-mercaptotetrazole | |
| Coating aid: | 10 mg/m² |
| Sodium dodecylbenzenesulfonate | |
| Comparative sensitizing dye C | |

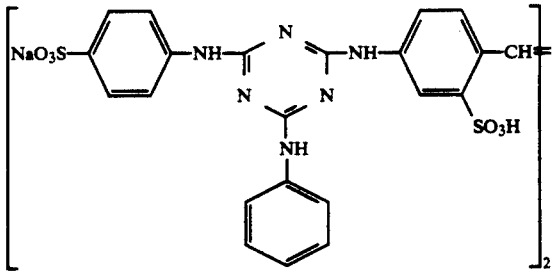

| (Protective layer) | |
|---|---|
| Binder: Gelatin | 1.5 g/m² |
| Coating aid: | 50 mg/m² |
| Sodium dodecylbenzenesulfonate | |
| Layer hardener: | 100 mg/m² |
| Sodium 2,4-dichloro-6-hydroxy-1,3,5-triazine | |

The resulting test samples were preserved for 2 days under the conditions of 40° C. and 80% RH so as to b serve as a fresh test sample. For the purpose of evaluating the raw stock stability, a 5-day aged sample was prepared by aging the fresh sample for 5 days under the conditions of 55° C. and 40% RH. The fresh sample was further subjected to a pressure test by making use of a scratch-meter manufactured by Haydon Co. from which the diamond styrus loads thereof were changed variously. The results of the evaluation are shown collectively in Table-2 in which the raw stock stability are exhibited in terms of the sensitivity variation values of the thermally aged samples each relative to the sensitivity of the fresh sample which are regarded as a value of 100. The samples are more excellent when the variation values thereof are smaller than others. In the pressure test, the evaluation was made by the load producing a pressure and the samples are more excellent when the evaluated values thereof are greater than others.

For the sensitometry and development process of each sample, the exposure was made through a continuous wedge for 500 CMS second; the development was made with Konica-Tone manufactured by Konica Corp. at 20° C. for 90 seconds; the fixing was made with Konica-Fix manufactured by Konica Corp. for 3 minuted; and the washing was made for 5 minutes; respectively.

The densities of the resulting samples were measured, so that the sensitivity values thereof were obtained in an ordinary method.

The results obtained therefrom are shown in Table-2 given below.

TABLE-2

| Sample No. | Emulsion No. | $RhCl_3$, (mol/mol AgX) | Sensitizing dye [BS-1] Exemplified dye | [BS-1] (mg/mol AgX) | [GS-1] Exemplified dye | [GS-1] (mg/mol AgX) | [RS-1] Exemplified dye | [RS-1] (mg/mol AgX) | Raw stock stability (relative sensitivity variation) | Pressure test, Load (g) | Remarks |
|---|---|---|---|---|---|---|---|---|---|---|---|
| 1 | A | — | Comp. dye A | 100 | Comp. dye B | 80 | Comp. dye C | 6 | 115 | 15 | Comp. sample |
| 2 | A | — | BS-1-2 | 100 | GS-1-3 | 80 | RS-1-5 | 6 | 110 | 15 | Comp. sample |
| 3 | A | — | — | — | GS-1-3 | 80 | RS-1-5 | 6 | 108 | 20 | Comp. sample |
| 4 | A | — | — | — | GS-1-5 | 70 | RS-1-7 | 5 | 112 | 15 | Comp. sample |
| 5 | B | $1 \times 10^{-9}$ | Comp. dye A | 100 | Comp. dye B | 80 | Comp. dye C | 6 | 122 | 20 | Comp. sample |
| 6 | B | $1 \times 10^{-9}$ | BS-1-2 | 100 | GS-1-3 | 80 | RS-1-5 | 6 | 120 | 20 | Comp. sample |
| 7 | B | $1 \times 10^{-9}$ | — | — | GS-1-3 | 80 | RS-1-5 | 6 | 119 | 15 | Comp. sample |
| 8 | B | $1 \times 10^{-9}$ | — | — | GS-1-5 | 70 | RS-1-7 | 5 | 120 | 20 | Comp. sample |
| 9 | C | $1 \times 10^{-8}$ | Comp. dye A | 100 | Comp. dye B | 80 | Comp. dye C | 6 | 161 | 35 | Comp. sample |
| 10 | C | $1 \times 10^{-8}$ | BS-1-2 | 100 | GS-1-3 | 80 | RS-1-5 | 6 | 130 | 35 | Inv. sample |
| 11 | C | $1 \times 10^{-8}$ | — | — | GS-1-3 | 80 | RS-1-5 | 6 | 125 | 40 | Inv. sample |
| 12 | C | $1 \times 10^{-8}$ | — | — | GS-1-5 | 70 | RS-1-7 | 5 | 123 | 35 | Inv. sample |
| 13 | D | $1 \times 10^{-7}$ | Comp. dye A | 100 | Comp. dye B | 80 | Comp. dye C | 6 | 165 | 45 | Comp. sample |
| 14 | D | $1 \times 10^{-7}$ | BS-1-2 | 100 | GS-1-3 | 80 | RS-1-5 | 6 | 128 | 40 | Inv. sample |
| 15 | D | $1 \times 10^{-7}$ | — | — | GS-1-3 | 80 | RS-1-5 | 6 | 125 | 45 | Inv. sample |
| 16 | D | $1 \times 10^{-7}$ | — | — | GS-1-5 | 70 | RS-1-7 | 5 | 127 | 45 | Inv. sample |
| 17 | E | $1 \times 10^{-5}$ | Comp. dye A | 100 | Comp. dye B | 80 | Comp. dye C | 6 | 173 | 45 | Comp. sample |
| 18 | E | $1 \times 10^{-5}$ | BS-1-2 | 100 | GS-1-3 | 80 | RS-1-5 | 6 | 133 | 50 | Inv. sample |
| 19 | E | $1 \times 10^{-5}$ | — | — | GS-1-3 | 80 | RS-1-5 | 6 | 129 | 45 | Inv. sample |
| 20 | E | $1 \times 10^{-5}$ | — | — | GS-1-5 | 70 | RS-1-7 | 5 | 131 | 45 | Inv. sample |
| 21 | F | $1 \times 10^{-4}$ | Comp. dye A | 100 | Comp. dye B | 80 | Comp. dye C | 6 | 193 | 45 | Comp. sample |
| 22 | F | $1 \times 10^{-4}$ | BS-1-2 | 100 | GS-1-3 | 80 | RS-1-5 | 6 | 172 | 45 | Inv. sample |
| 23 | F | $1 \times 10^{-4}$ | — | — | GS-1-3 | 80 | RS-1-5 | 6 | 175 | 40 | Inv. sample |
| 24 | F | $1 \times 10^{-4}$ | — | — | GS-1-5 | 70 | RS-1-7 | 5 | 170 | 45 | Inv. sample |

Comp.: Comparative sample
Inv.: Inventive sample

From the results shown in Table-2, the following facts were proved.

(1) With the samples in which $RhCl_3$ was not contained or was contained in an amount smaller than the specific range of the invention, (i.e., samples No.1 through No.8), they were excellent in raw sample preservability, because the sensitivities thereof were not so much varied, but the pressure resistance thereof were deteriorated, because the pressure marks were produced even by a substantially light load.

(2) With the samples into which $RhCl_3$ was contained in an amount within the specific range of the invention into which the sensitizing dyes outside the scope of the invention were further added, (i.e., samples No. 9, No. 13 and No. 17), they were excellent in the pressure resistance, but they were seriously deteriorated in raw stock stability.

(3) With the samples in which $RhCl_3$ was contained in an amount within the specific range of the invention and the sensitizing dyes of the invention were also added therein, they were excellent in both raw stock stability and pressure resistance.

(4) With the samples in which $RhCl_3$ was contained in an amount more than the specific range of the invention, (i.e., samples No. 22 through No. 24), they were excellent in pressure resistance, but deteriorated in raw stock stability, and it was also proved that the amounts of $RhCl_3$ contained therein were proper by collectively taking the results given in the above item (1) into consideration.

EXAMPLE-2

Emulsion G was prepared in the following manner. [$RhCl_3$] and $K_2[Ir(IV)Cl_6]$ were each applied in combination into solution III, by making use of Emulsion D having used in Example-1 and the same chemical formula as for Emulsion D. The resulting emulsion G was chemically ripened and was then spectrally sensitized variously by varying the kinds of sensitizing dyes in the same manner as in Example-1 as shown in Table-3. After that, the same evaluations were made as in Example-1.

As shown in Table-3, an aqueous hydroquinone solution was added into the coating solution. The same evaluations were made as in Example-1. The results thereof are shown in Table-3 give below.

TABLE-3

| Sample No. | Emulsion No. | $RhCl_3$, (mol/mol AgX) | $K_2[Ir(IV)Cl_6]$ of (mol/mol AgX) | Sensitizing dye [GS-1] Exemplified dye | Sensitizing dye [GS-1] (mg/mol AgX) | Sensitizing dye [RS-1] Exemplified dye | Sensitizing dye [RS-1] (mg/mol AgX) | Hydroquinone (mol/mol of AgX) | Raw stock stability (relative sensitivity variation) | Pressure test, Load (g) | Remarks |
|---|---|---|---|---|---|---|---|---|---|---|---|
| 25 | D | $1 \times 10^{-7}$ | — | Comp. dye B | 60 | Comp. dye C | 4 | — | 160 | 40 | Comp. sample |
| 26 | D | $1 \times 10^{-7}$ | — | Comp. dye B | 80 | Comp. dye C | 5 | — | 175 | 45 | Comp. sample |
| 27 | D | $1 \times 10^{-7}$ | — | GS-1-3 | 80 | RS-1-1 | 5 | — | 124 | 40 | Inv. sample |
| 28 | D | $1 \times 10^{-7}$ | — | GS-1-3 | 80 | RS-1-2 | 5 | — | 131 | 45 | Inv. sample |
| 29 | D | $1 \times 10^{-7}$ | — | GS-1-3 | 80 | RS-1-4 | 5 | — | 125 | 45 | Inv. sample |
| 30 | D | $1 \times 10^{-7}$ | — | GS-1-6 | 80 | RS-1-5 | 5 | — | 127 | 40 | Inv. sample |
| 31 | D | $1 \times 10^{-7}$ | — | GS-1-10 | 80 | RS-1-5 | 5 | — | 130 | 45 | Inv. sample |
| 32 | D | $1 \times 10^{-7}$ | — | GS-1-14 | 80 | RS-1-5 | 5 | — | 121 | 45 | Inv. sample |
| 33 | D | $1 \times 10^{-7}$ | — | GS-1-14 | 80 | RS-1-5 | 5 | $1 \times 10^{-3}$ | 116 | 45 | Inv. sample |
| 34 | D | $1 \times 10^{-7}$ | — | GS-1-14 | 80 | RS-1-5 | 5 | $1 \times 10^{-2}$ | 110 | 45 | Inv. sample |
| 35 | G | $1 \times 10^{-7}$ | $2.9 \times 10^{-7}$ | Comp. dye B | 60 | Comp. dye C | 4 | — | 172 | 45 | Comp. sample |
| 36 | G | $1 \times 10^{-7}$ | — | Comp. dye B | 80 | Comp. dye C | 5 | — | 168 | 40 | Comp. sample |
| 37 | G | $1 \times 10^{-7}$ | — | GS-1-3 | 80 | RS-1-1 | 5 | — | 125 | 45 | Inv. sample |
| 38 | G | $1 \times 10^{-7}$ | — | GS-1-3 | 80 | RS-1-2 | 5 | — | 132 | 50 | Inv. sample |
| 39 | G | $1 \times 10^{-7}$ | — | GS-1-3 | 80 | RS-1-4 | 5 | — | 134 | 50 | Inv. sample |
| 40 | G | $1 \times 10^{-7}$ | — | GS-1-6 | 80 | RS-1-5 | 5 | — | 130 | 55 | Inv. sample |
| 41 | G | $1 \times 10^{-7}$ | — | GS-1-10 | 80 | RS-1-5 | 5 | — | 129 | 55 | Inv. sample |
| 42 | G | $1 \times 10^{-7}$ | — | GS-1-14 | 80 | RS-1-5 | 5 | — | 121 | 60 | Inv. sample |
| 43 | G | $1 \times 10^{-7}$ | — | GS-1-14 | 80 | RS-1-5 | 5 | $1 \times 10^{-3}$ | 108 | 60 | Inv. sample |
| 44 | G | $1 \times 10^{-7}$ | — | GS-1-14 | 80 | RS-1-5 | 5 | $1 \times 10^{-2}$ | 107 | 60 | Inv. sample |

Comp.: Comparative sample
Inv.: Inventive sample

From the above-given Table-3, it was proved that the samples of the invention were excellent in quality, because they can reproduce the same results obtained in Example-1 in both raw stock stability and pressure resistance. And, the addition of $K_2[Ir(IV)Cl_6]$ can apparently make the pressure resistance excellent, and the addition of hydroquinone can make the raw stock stability more excellent, so that these samples of the invention are included in the preferable embodiments of the invention When making a print from a color negative film by making use of Sample No. 33 of the invention, it was proved that a high image-quality black-and-white print could be obtained with the excellent results of the color density reproduction of the subject, image sharpness and graininess either.

What is claimed is:

1. A silver halide black and white photographic light-sensitive printing material comprising a support having thereon a silver halide emulsion layer comprising silver halide grains, wherein said silver halide grains contain rhodium in an amount of $10^{-8}$ to $10^{-5}$ mols per mol of silver halide; and said grains are spectrally sensitized with a combination of sensitizing dyes [GS-1) and (RS-1), each represented by the following formula:

formula (GS-1)

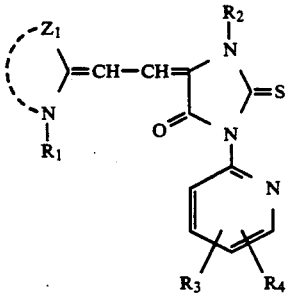

wherein $Z^1$ represents a group consisting of non-metal atoms necessary for forming an oxazole ring, a benzoxazole ring or a naphthoxazole ring, each of which may have a substituent; $R^1$ and $R^2$ each represent an alkyl group; $R^3$ and $R^4$ each represent a hydrogen atom, an alkyl group, an alkoxy group, a sulfo group, a sulfoalkyl group, a carboxy group or a halogen atom;

formula (RS-1)

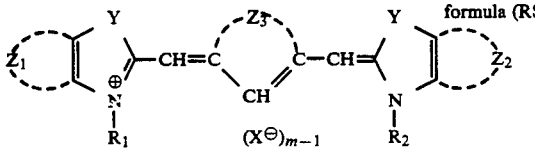

wherein $R^1$ and $R^2$ each represent an alkyl group; $Z^1$ and $Z^2$ each represent a group consisting of non-metal atoms necessary for forming a benzene ring or a naphthalene ring; $Z^3$ represents a group consisting of atoms necessary for forming a 6-membered hydrocarbon ring; m is an integer of 1 or 2; Y represents a sulfur atom or a selenium atom; and X represents an anion.

2. The photographic material of claim 1, wherein said silver halide grains comprise silver bromide, silver chlorobromide or silver chloride.

3. The photographic material of claim 1, wherein said silver halide grains are prepared by a process comprising forming said silver halide grains by mixing a silver salt solution and a halide solution and subsequently performing physical ripening, wherein a water soluble rhodium salt are made present at a time during the process of preparing said silver halide grains.

4. The photographic material of claim 3, wherein said water soluble rhodium salt is added into the halide solution.

5. The photographic material of claim 1, wherein said silver halide grains are spectrally sensitized further with a sensitizing dye (BS-1) represented by the following formula:

Formula (BS-1)

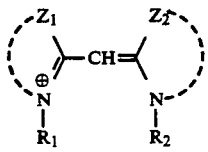

wherein $Z^1$ and $Z^2$ represent each a group consisting of non-atomic atoms necessary for forming an oxazole ring, a thiazole ring, a selenazole ring, a pyridine ring, a benzoxazole ring, a benzoselenazole ring, a benzoimidazole ring, a naphthoxazole ring, naphthothiazole ring, a naphthoselenazole ring, a naphthoimidazole ring or a quinoline ring; $R^1$ and $R^2$ each represent an alkyl group, an alkenyl group or an aryl group; X represents an anion; and m is an integer of 1 or 2.

6. The photographic material of claim 5, wherein said sensitizing dyes represented by the formulas (GS-1), (RS-1) and (BS-1) each are added in an amount of $1\times10^{-7}$ to $1\times10^{-2}$ mols per mol of silver halide.

7. The photographic material of claim 1, wherein said silver halide emulsion layer comprises a developing agent in an amount of $1\times10^{-4}$ to $1\times10^{-1}$ mols per mol of silver halide.

8. The photographic material of claim 7, wherein said developing agent is hydoquinone, chlorohydroquinone, catechol, 1-phenyl-3-pyrazolidone, 1-phenyl-4,4-dimethyl-3-pyrazolidone or 1-phenyl-4-methyl-4-hydroxymethyl-3-pyrazolidone.

9. The photographic material of claim 1, wherein said sensitizing dyes represented by the formulas (GS-1) and (RS-1) each are added in an amount of $1\times10^{-7}$ to $1\times10^{-2}$ mols per mol of silver halide.

10. The photographic material of claim 9 wherein said dye represented by formula (GS-1) is one of the following dyes GS-1-1 through GS-1-16 and said dye represented by formula RS-1 is one of the following dyes RS-1-1 through RS-1-8:

GS-1-1

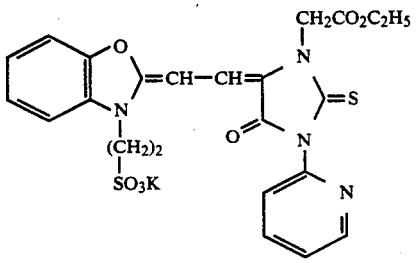

GS-1-2

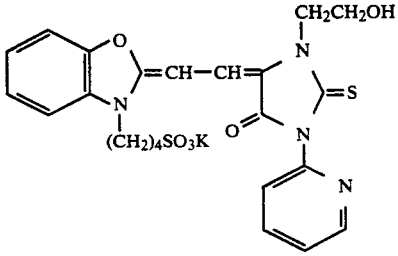

-continued
GS-1-3
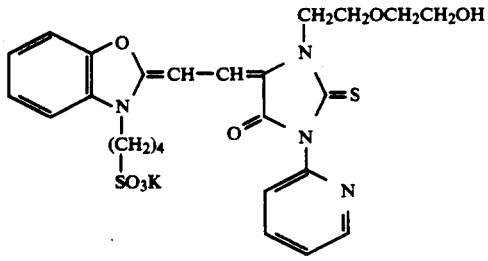
GS-1-4
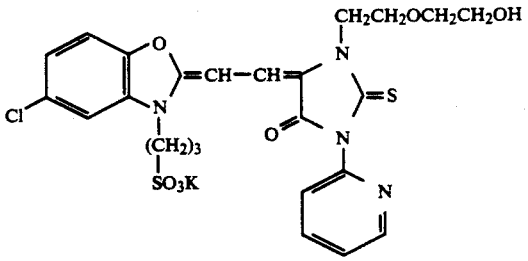
GS-1-5
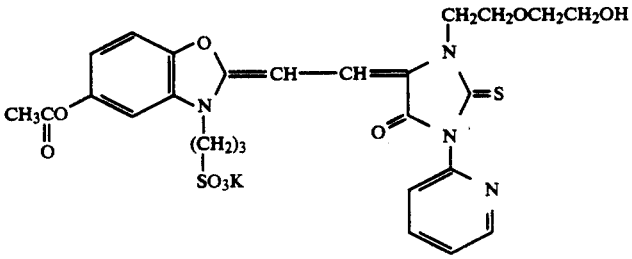
GS-1-6
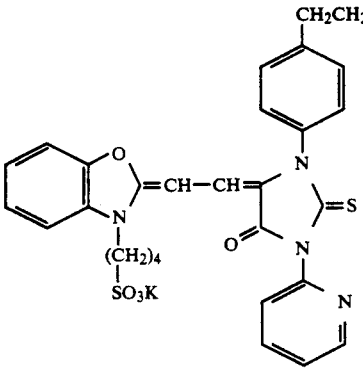
GS-1-7
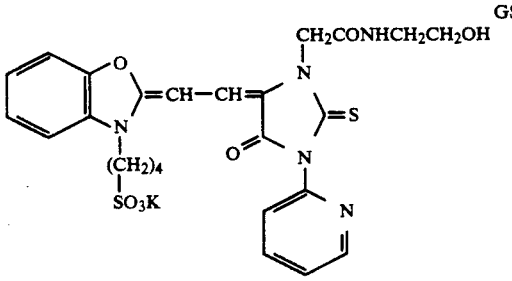
GS-1-8
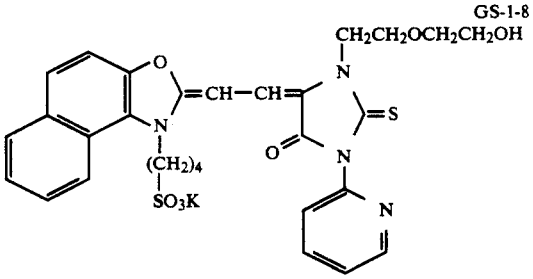
GS-1-9
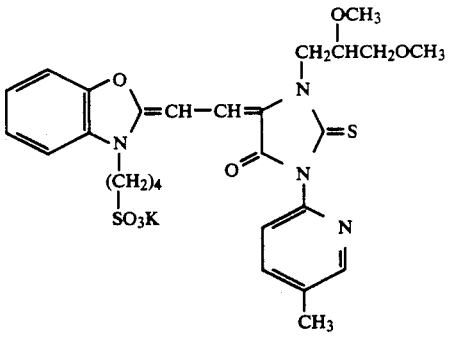
GS-1-10
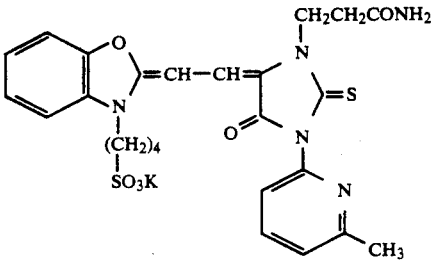
GS-1-11
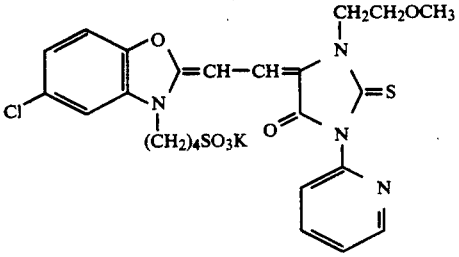

-continued
GS-1-12
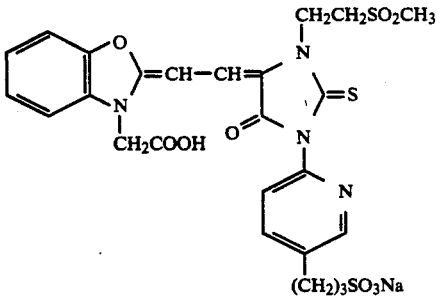
GS-1-13
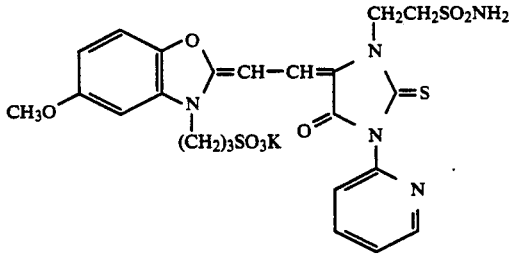
GS-1-14
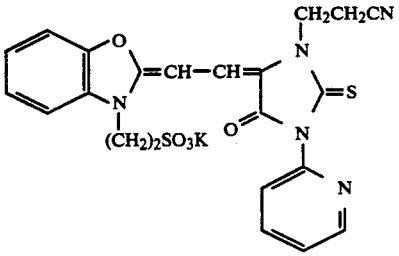
GS-1-15
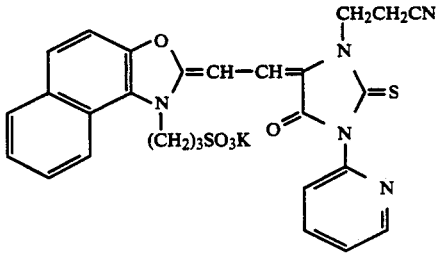
GS-1-16
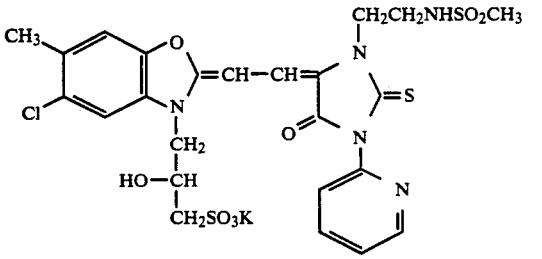
RS-1-1
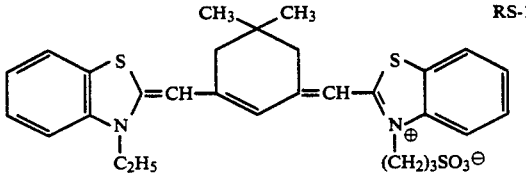
RS-1-2
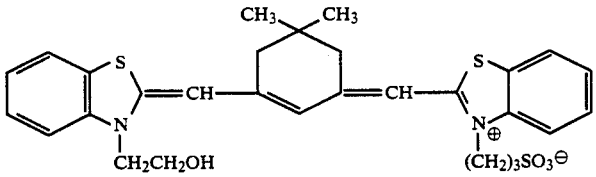
RS-1-3
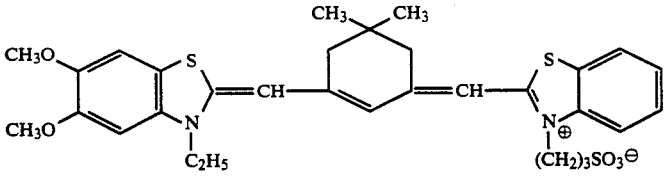
RS-1-4
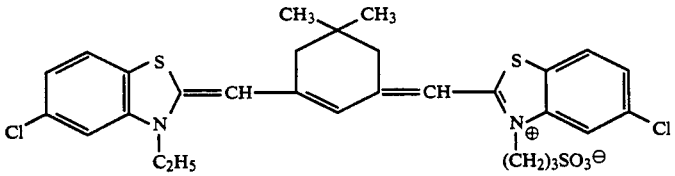
RS-1-5
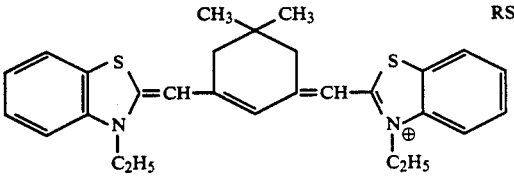
RS-1-6
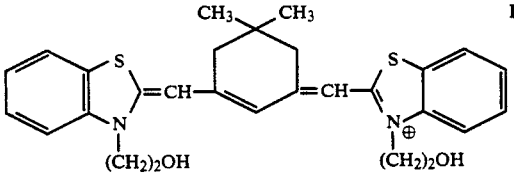

-continued
RS-1-7
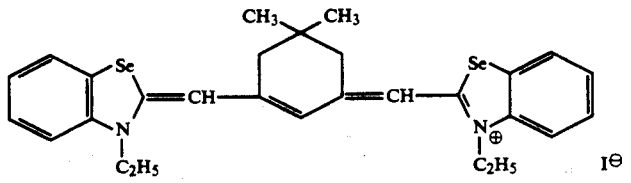
RS-1-8
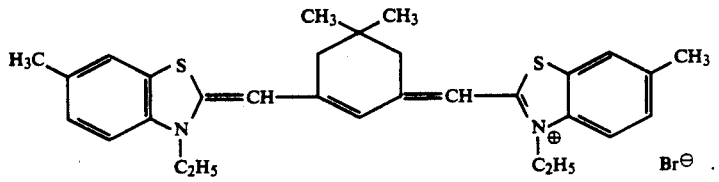
20
11. The photographic material of claim 6 wherein said dye represented by the formula GS-1 is one of the following dyes GS-1-1 through GS-1-16; said dye represented by formula RS-1 is one of the following dyes RS-1-1 through RS-1-8; and said dye represented by the formula BS-1 is one of the following dyes BS-1-1 through BS-1-8:
GS-1-1
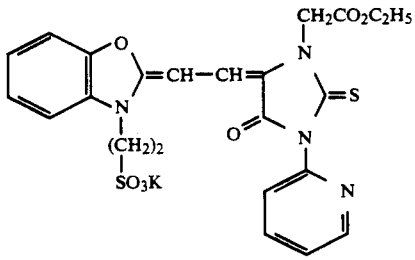
GS-1-2
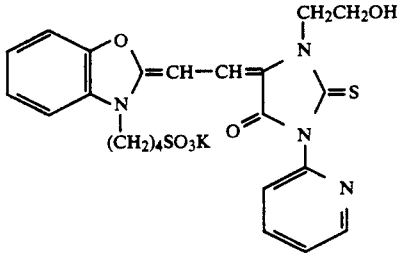
GS-1-3
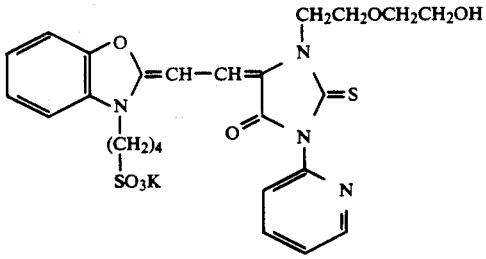
GS-1-4
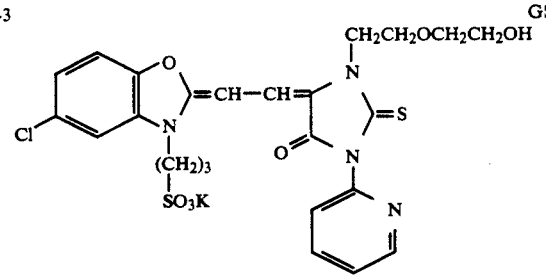
GS-1-5
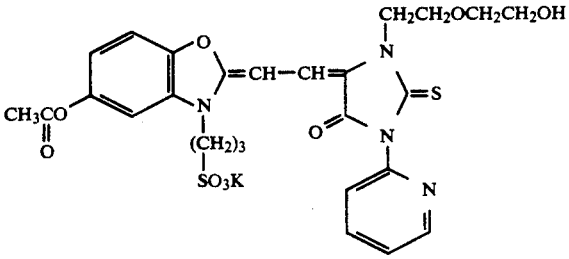

-continued
GS-1-6
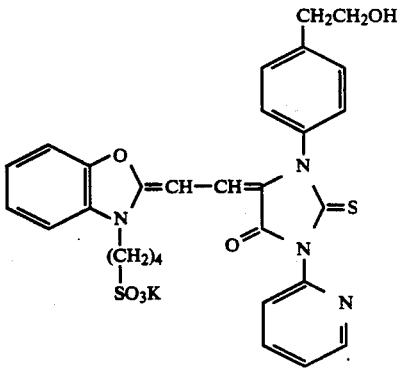
GS-1-7
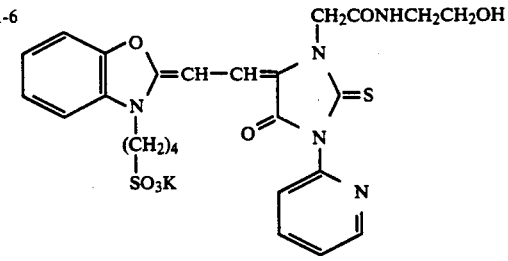
GS-1-8
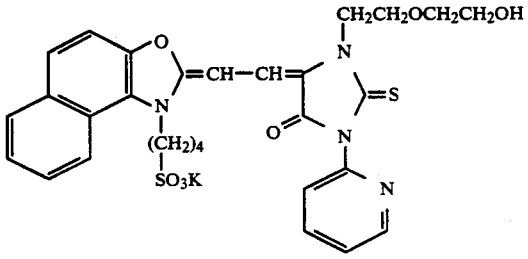
GS-1-9
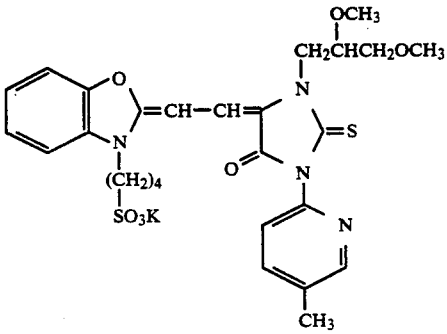
GS-1-10
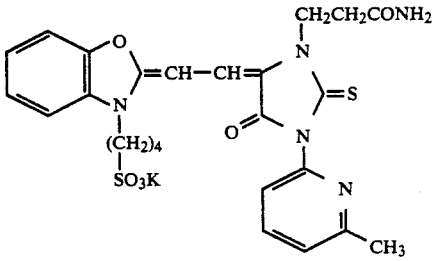
GS-1-11
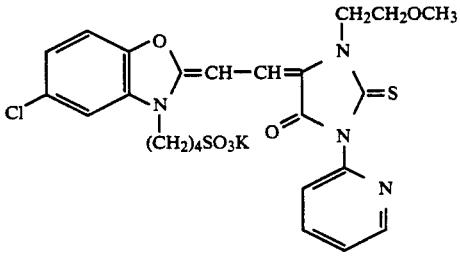
GS-1-12
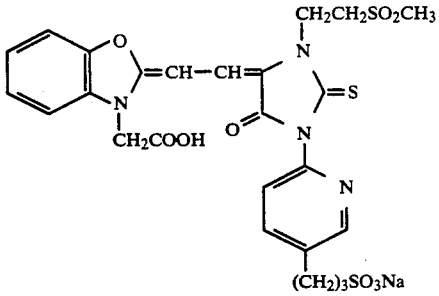
GS-1-13
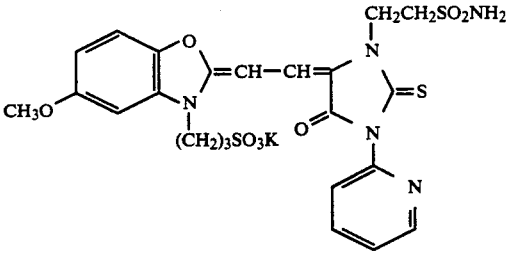
GS-1-14
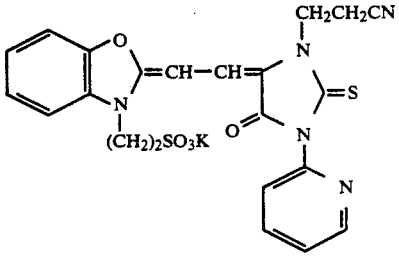
GS-1-15
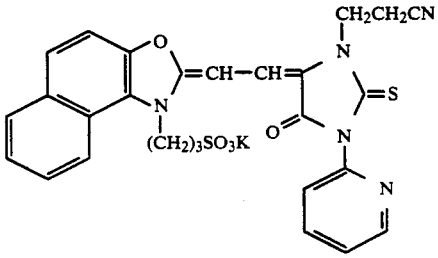

-continued
GS-1-16
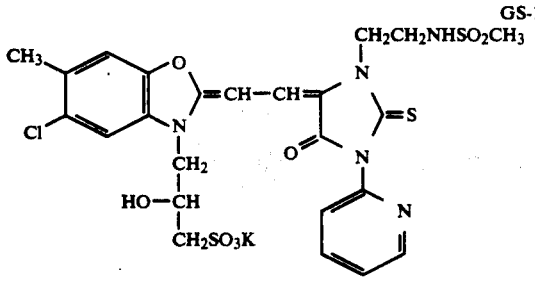
RS-1-1
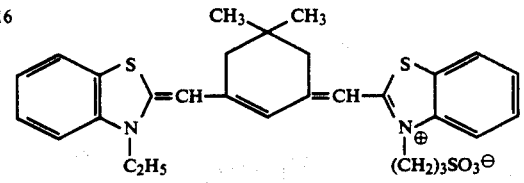
RS-1-2
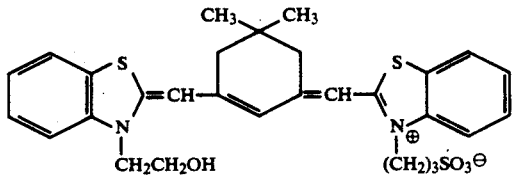
RS-1-3
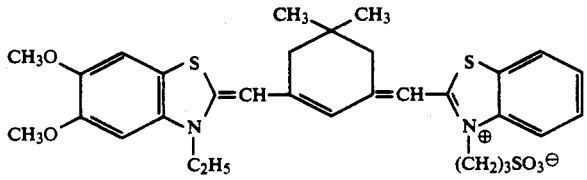
RS-1-4
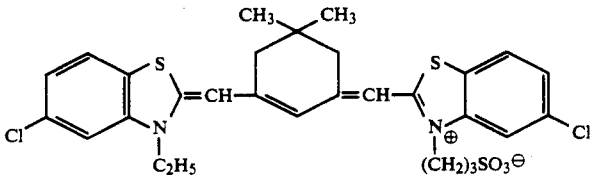
RS-1-5
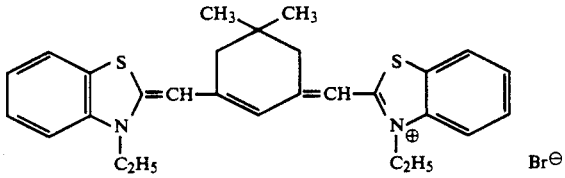
RS-1-6
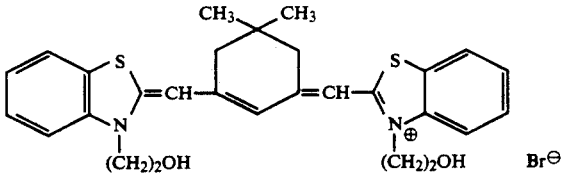
RS-1-7
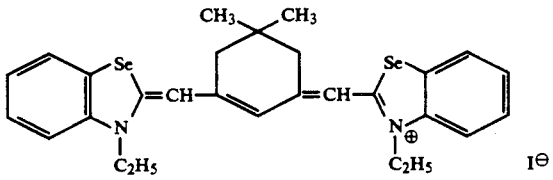
RS-1-8
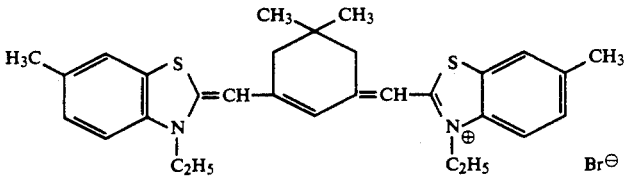

-continued
BS-1-1
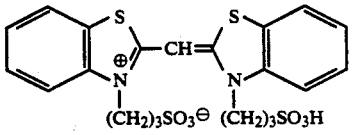
BS-1-2
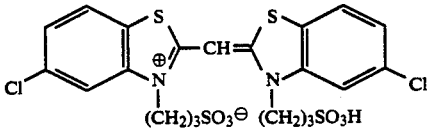
BS-1-3
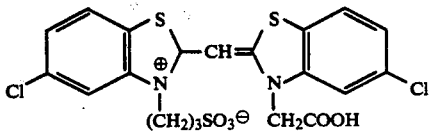
BS-1-4
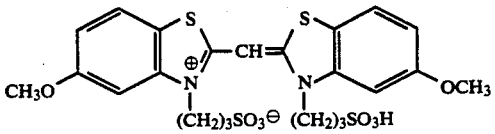
BS-1-5
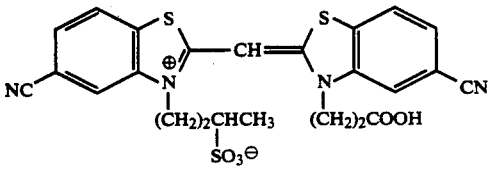
BS-1-6
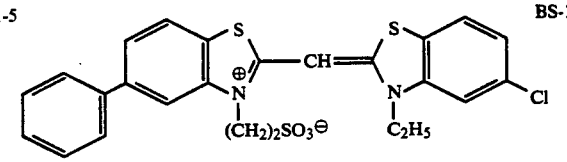
BS-1-7
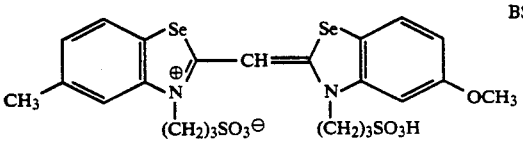
BS-1-8
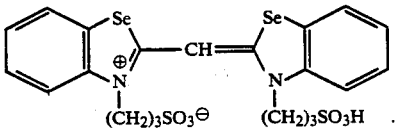
* * * * *